US005743753A

United States Patent [19]

Yen

[11] Patent Number: 5,743,753

[45] Date of Patent: Apr. 28, 1998

[54] WATERTIGHT ELECTRICAL PLUG

[76] Inventor: Chun Chang Yen, No. 8, Ln. 247, Niu Pu Rd., Hsinchu, Taiwan

[21] Appl. No.: 753,492

[22] Filed: Nov. 26, 1996

[51] Int. Cl.[6] ..... H01K 13/44

[52] U.S. Cl. ..... 439/143

[58] Field of Search ..... 439/142, 143, 439/145, 587, 589, 695, 139

[56] References Cited

U.S. PATENT DOCUMENTS

| | | | |
|---|---|---|---|
| 2,119,428 | 5/1938 | Englar | 247/23 |
| 2,498,642 | 2/1950 | Bellek | 174/67 |
| 4,514,024 | 4/1985 | Clark | 339/143 |
| 5,096,432 | 3/1992 | Cullen et al. | 439/139 |
| 5,286,213 | 2/1994 | Altergott et al. | 439/139 |

*Primary Examiner*—Gary F. Paumen
*Assistant Examiner*—Katrina Davis
*Attorney, Agent, or Firm*—Morton J. Rosenberg; David I. Klein

[57] ABSTRACT

The invention relates to an improved watertight electrical plug. The plug mainly comprises a plug body having a spherical end face and a cover. The plug body includes two curved grooves on the end face thereof and an engaging groove on the cylindrical surface thereof around the end face for an engagement with the cover. The cover is provided with an inwardly extending flange that is used to secure the cover when the cover snaps on the end face. Therefore the plug of the invention can obtain a watertight effect.

1 Claim, 3 Drawing Sheets

WATERTIGHT ELECTRICAL PLUG

BACKGROUND OF THE INVENTION

An average electrical plug of serially connected type is provided at one end with blades to be inserted into a receptacle and at the other end with two slots as a receptacle for receiving blades of another plug. However, there is a major drawback of the penetration of water from exposed slots into such a conventional plug structure. Consequently, it often leads to a short circuit or electrical leakage. Although some preventive measures have been taken to close the slots by insertion plates, the method is not efficient enough and water can still enter the plug. In addition, it is also inconvenient that users must remove the insertion plates before the use of the plug, not to mention that the detached insertion plates might be missed.

BRIEF DESCRIPTION OF THE ACCOMPANYING DRAWINGS

It is therefore an object of the invention to provide an improved watertight electrical plug that uses a rotatable cover to tightly close the end face of the plug and which ensures a water impenetrable effect and provides users with convenience in use.

Now a detailed description of the structure and features of the invention will be given hereinafter with reference to the accompanying drawings in which.

DETAILED DESCRIPTION OF A PREFERRED EMBODIMENT

Figure 1:
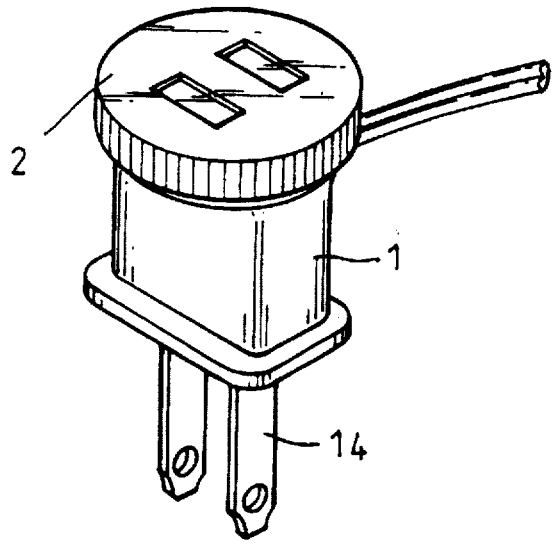
FIG. 1 is a perspective view showing a plug assembly according to the invention.
Figure 2:
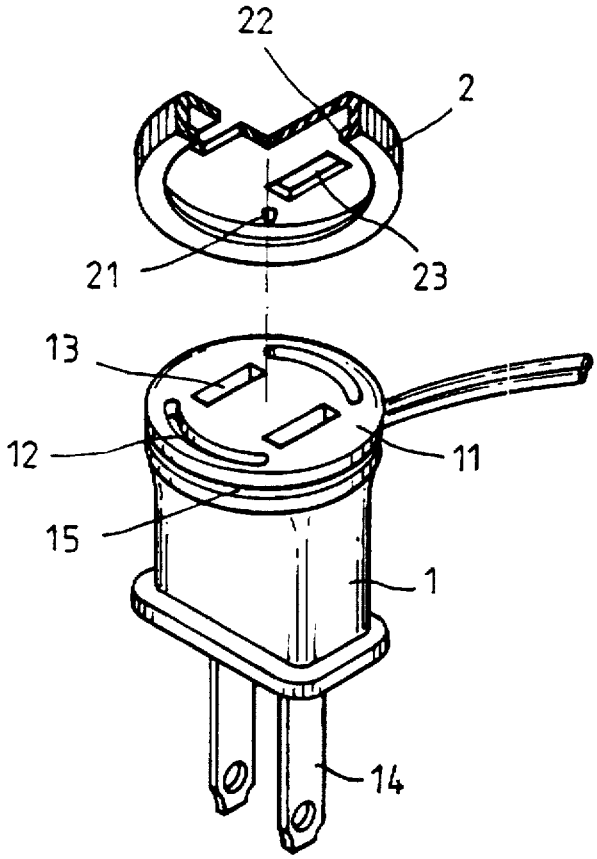
FIG. 2 is an exploded and partially cross sectional view separately showing parts of the plug of FIG. 1.
Figure 3:
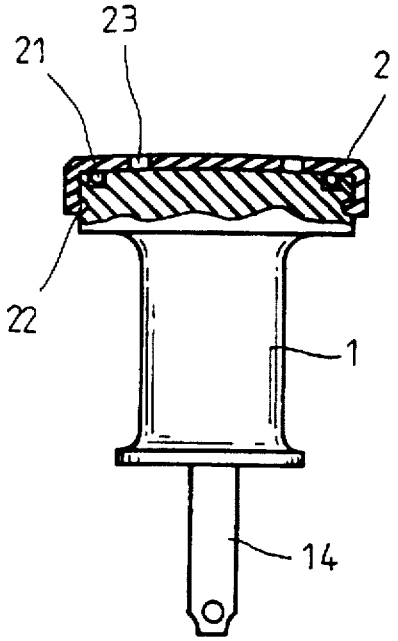
FIG. 3 is a partially cross sectional and plan view showing the plug of FIG. 1 in an assembled state.

First referring to FIGS. 1 through 3, the invention includes a plug body (1) and a cover (2), the plug body (1) being provided at one end with two plug blades (14) and at the opposite end (11) with two corresponding slots (13). The plug body (1) according to the invention is characterized by two curved grooves (12) formed on the end face (11). The end face (11) is a slightly raised spherical surface. An annular engaging groove (15) is formed on the cylindrical side surface around the end face (11) and an inwardly extending flange (22) is disposed on the cylindrical inner wall of the cover (2) at the end edge. The cover (2) further includes two downwardly bossed locating bulges (21) arranged on the underside thereof and two elongated slots (23) on the top surface. The cover (2) is intended to be installed on the end face (11) of the plug (1), with the flange (22) engaged with the groove (15) and two bossed locating bulges (21) respectively dwelling in two curved grooves (12).

Figure 4:
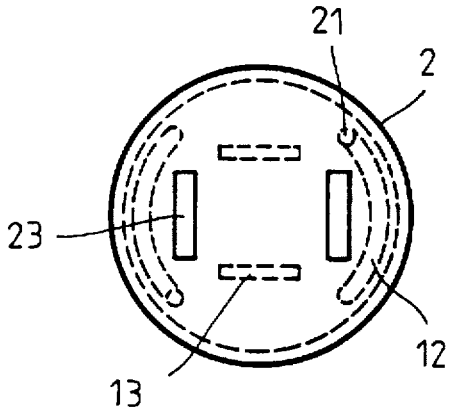
FIG. 4 is a top view of the plug of the invention.
Figure 5:
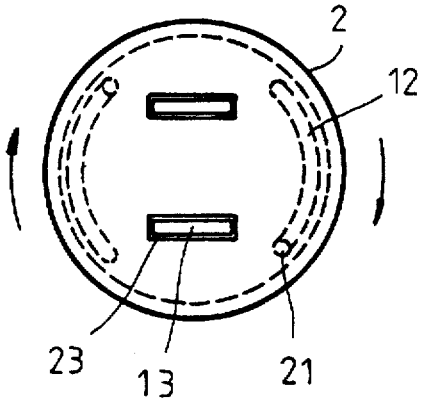
FIG. 5 illustrates the rotating movements of the plug of FIG. 4.

With the above arrangement, when the plug body (1) is coupled with the cover (2), the spherical end face (11) can reach the underside of the cover (2) to seal the access to the interior of the plug body so that it can obtain an excellent watertight effect as shown in FIGS. 3 and 4. When two slots (13) are to be used, users can rotate the cover (2) as shown in FIG. 5 and then the elongated grooves (23) of the cover (2) can be easily moved to such a position by means of the displacement of the locating bulges in the curved grooves that users can insert blades of another plug into the slots (13) through the elongated slots (23). When not in use, just rotate the cover in a reversed direction to close the end face of the plug body and the plug of the invention can be sealed in a watertight state. From the above description it is evident that the invention can reach the above-mentioned objects.

What is claimed is:

1. An improved watertight electrical plug comprising a plug body and a cover wherein said plug body is configured to have a slightly raised spherical end face and a cylindrical wall substantially encircling said end face, said watertight electrical plug being provided with two symmetrical curved grooves on the end face and an annular engaging grooves on the cylindrical wall around said end face, said end face having formed therein a pair of elongate electrical connection slots adapted to receive prongs of a mating plug, said cover includes an inwardly extending flange at a lower end thereof in engagement with said engaging groove in order to snap said cover on the end face of the plug body, two downwardly projecting locating bulges on the underside of said cover at positions corresponding to said two symmetrical curved grooves, and two elongate slots on the top surface of said cover corresponding to the slots on the end face of said plug body, whereby said cover is angularly displaceable relative to said plug body between an open position and a sealed position, said elongate slots of said cover being substantially aligned with said elongate slots of said plug body end face when said cover is in said open position.

* * * * *